US008016019B2

(12) United States Patent
Shibata et al.

(10) Patent No.: US 8,016,019 B2
(45) Date of Patent: Sep. 13, 2011

(54) CASTING METHOD

(75) Inventors: Kiyoshi Shibata, Tokyo (JP); Toshirou Ichihara, Tokyo (JP); Keizou Tanoue, Tokyo (JP); Kouzou Miyamoto, Tokyo (JP); Masamitsu Yamashita, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/596,549

(22) PCT Filed: Apr. 17, 2008

(86) PCT No.: PCT/JP2008/057521

§ 371 (c)(1),
(2), (4) Date: Oct. 26, 2009

(87) PCT Pub. No.: WO2008/133184

PCT Pub. Date: Nov. 6, 2008

(65) Prior Publication Data

US 2010/0071865 A1 Mar. 25, 2010

(30) Foreign Application Priority Data

Apr. 19, 2007 (JP) ..... 2007-110804
Apr. 2, 2008 (JP) ..... 2008-095707

(51) Int. Cl.
*B22D 18/04* (2006.01)

(52) U.S. Cl. ..... 164/119; 164/122.1; 164/138

(58) Field of Classification Search ..... 164/119, 164/122.1, 138

See application file for complete search history.

(56) References Cited

U.S. PATENT DOCUMENTS 4,875,518 A 10/1989 Imura et al.
2003/0024682 A1* 2/2003 Tsuchiya et al. ..... 164/312

FOREIGN PATENT DOCUMENTS

| | | | |
|---|---|---|---|
| JP | 62-021450 | | 1/1987 |
| JP | 04-053755 | | 3/1989 |
| JP | 64-053757 | | 3/1989 |
| JP | 2 208 817 | | 4/1989 |
| JP | 01-237067 | | 9/1989 |
| JP | 02-037953 | | 2/1990 |
| JP | 2000-094115 | | 4/2000 |
| JP | 2002-178129 | | 6/2002 |
| JP | 2003138342 | A * | 5/2003 |
| JP | 2005-307242 | | 11/2005 |

* cited by examiner

*Primary Examiner* — Jessica L Ward
*Assistant Examiner* — Nicholas D'Aniello
(74) *Attorney, Agent, or Firm* — Rankin, Hill & Clark LLP

(57) ABSTRACT

The object of the present invention is to provide a casting method capable of simultaneously attaining the shortening of cycle time and the improvement in casting quality.

The pressure allowing the molten metal level to go up to the positions of from P0 to P4 is applied to the molten metal within a molten metal reservoir 1. Then, the pressure of P4 is maintained for a predetermined time. During this time, the molten metal which comes into contact with an upper die 4 is cooled earlier than the molten metal being in contact with another die. Through this cooling the molten metal shrinks. However, since the pressure of P4 is maintained, the molten metal is supplied from the lower side to a shrunk portion, so as not to cause shrinkage cavity or underfill.

16 Claims, 5 Drawing Sheets

CASTING METHOD

TECHNICAL FIELD

The present invention relates to a casting method suitable for pressure (low pressure) casting a molten metal such as an aluminum alloy or the like for example.

BACKGROUND ART

In order for lightening a load relative to the environment, weight reduction of an engine, etc. are desired and there is an increase in the application of an aluminum alloy. Also, in view of a demand for an improvement in productivity, a reduction in casting time by the pressure casting is sought.

However, there is a problem of shrinkage cavity in the casting, and proposals for solving the problem are made for example by patent references 1 to 3. In patent reference 1, there is proposed the art that an upper die, a lower die and a slide die each are comprised of materials different in heat conductivity, and the die of low heat conductivity is used as the die corresponding to a thin section of a casting product so as to carry out directional solidification.

In patent reference 2 and patent reference 3, there is also proposed the art that an upper die is comprised of a copper alloy of high heat conductivity, a lower die is comprised of metallic material of carbon tool steel having lower heat conductivity than the upper die, and a slide die is comprised of metallic material having intermediate heat conductivity relative to the upper die and the lower die so as to carry out the directional solidification by the use of the difference in heat conductivity.

Patent reference 1: Japanese patent application publication No. H01-237067.

Patent reference 2: Japanese patent application publication No. H01-053755.

Patent reference 3: Japanese patent application publication No. H01-053757.

DISCLOSURE OF THE INVENTION

Problem to be Solved by the Invention

The method disclosed in patent reference 1 is not able to control the directional solidification and has the die of low heat conductive material located in the thin section of the casting product, so that it merely can be used for a product of simple cross-section such as a wheel.

In the case of using the copper alloy as a material of a metal mold, as disclosed in patent reference 2 and patent reference 3, the copper alloy is expensive and inferior in durability thereby being subject to generating erosion.

In addition, since the heat conductively is too high, a defect such as underfill is liable to be generated in an undercut section in the case of carrying out the directional solidification. Particularly, in the casting by combination between a copper mold and a sand core, the difference in heat conductivity between them is large, so that in the case where the space between the copper mold and the sand core is narrow, the viscosity of the molten metal is lessened in this narrow section, thereby causing a filling failure so as to generate the erosion.

Moreover, in the case of setting the sand core in a cavity, the sand core is inferior in the heat conductivity so that it incurs the delay of cooling solidification so as to make cycle time longer.

Further, in the conventional casting method, it takes much time until the molten metal is solidified at a sprue section, so that the tact time up to unloading the product becomes longer. In the metal mold having a projection for casting hole provided directly above the sprue or the construction of inserting an insert and a pin, also there is a problem that the temperature of the metal mold is liable to be uneven.

Means for Solving the Problem

For solving the above mentioned problems, a casting method, in accordance with the present invention, of pressure filling a molten metal from a lower side through a sprue into a cavity defined by an upper die and a lower die or into a cavity defined by the upper die, the lower die and a side die so as to solidify the molten metal, comprises: using, as a die material forming the upper die, a die material which is higher in heat conductivity than a die material of another die, and whose heat conductivity in an operating temperature of 150° C.-550° C. is 34-41 $W\cdot(m\cdot K)^{-1}$ and whose heat conductivity increases as the temperature decreases, and keeping the pressurized state until a sprue temperature becomes lower than a solidification temperature of the molten metal to cover a shrinkage of the molten metal accompanying the cooling by the upper die.

Namely, the upper die which is higher in the heat conductivity is adapted to facilitate the solidification cooling and shrinkage of the molten metal, and the sprue provided in the lower die which is lower in the heat conductivity than the upper die is adapted to perform the pressure filling function, so as to have the cooling and solidification gradually carried out. In other words, the quality of the cast product is stabilized by the directional solidification.

Also, the casting method, in accordance with the present invention, of pressure filling a molten metal from a lower side through a sprue into a cavity defined by an upper die and a lower die or into a cavity defined by the upper die, the lower die and a side die so as to solidify the molten metal, comprises: using, as a material forming the sprue, a material whose heat conductivity in an operating temperature of 150° C.-550° C. is 34-41 $W\cdot(m\cdot K)^{-1}$ and whose heat conductivity increases as the temperature decreases, and controlling the sprue to be forcibly cooled by an air cooling device or the like at the same time that the supply of the molten metal into the cavity is stopped. In this way, the cycle time is shortened.

As the sprue is formed of the material which is higher in the heat conductivity, the temperature of the sprue at the beginning of filling the molten metal into the cavity increases in a short time thereby making it smooth to fill the cavity with the molten metal, while after the filling is completed, the molten metal of the sprue can be solidified in a short time by the forced cooling.

Further, in the casting method, in accordance with the present invention, of pressure filling a molten metal from a lower side through a sprue into a cavity defined by an upper die and a lower die or into a cavity defined by the upper die, the lower die and a side die so as to solidify the molten metal, a material whose heat conductivity in an operating temperature of 150° C.-550° C. is 34-41 $W\cdot(m\cdot K)^{-1}$ such that the heat conductivity increases as the temperature decreases, is used, as a material for an air vent, an insert or a casting pin for hole, so as to make the temperature within the cavity uniform. Like this, it is possible to make uniform the temperature in the thick wall portion, between the sand core and the metal mold, and in the location directly above the sprue, that is, the temperature of the metal mold, thereby improving the quality of the product.

As a specific composition of the material whose heat conductivity in an operating temperature of 150° C.-550° C. is 34-41 $W\cdot(m\cdot K)^{-1}$ and whose heat conductivity increases as the temperature decreases, it is preferable that the composition comprises for example, by mass content, 0.15% or more and 0.35% or less of C, 0.05% or more and less than 0.20% of Si, 0.05% or more and 1.50% or less of Mn, 0.20% or more and 2.50% or less of Cr, 0.50% or more and 3.00% or less of Mo, 0.05% or more and 0.30% or less of V, and the balance essentially Fe, and has Rockwell hardness from not less than 30 HRC to not more than 40 HRC.

Preferably, the composition further contains 0.0002% or more and 0.0020% or less of B, 0.0005% or more and 0.0100% or less of Ca, 0.01% or more and 0.15% or less of Se, 0.01% or more and 0.15% or less of Te, and 0.003% or more and 0.20% or less of Zr.

Effects of the Invention

According to the casting method of the present invention, since the high heat conductive metallic material is used for the upper die, the cycle time can be shortened by acceleration of heat radiation and a dendrite tissue of a contact surface of the upper die can be fined by acceleration of cooling speed. Moreover, since the supply of the molten metal into the cavity is increased and the pressurized state is kept for a predetermined time until a sprue temperature becomes lower than the solidification temperature of the molten metal thereby to cover the shrinkage of the molten metal accompanying the cooling by the upper die, the improvement of the casting quality can be also accomplished.

Namely, in the casting, the upper die which is higher in the heat conductivity serves to facilitate the solidification cooling and shrinkage of the molten metal, and the sprue provided in the lower die which is lower in the heat conductivity than the upper die is adapted to perform the pressure filling function, so as to have the cooling and solidification gradually carried out.

In other words, the quality of the cast product is stabilized by the directional solidification.

Particularly, as the high heat conductive material, there is used the material whose heat conductivity in the operating temperature of 150° C.-550° C. is 34-41 $W\cdot(m\cdot K)^{-1}$, and whose heat conductivity increases as the temperature decreases. Therefore, it is possible to effectively carry out the directional solidification. That is, in the case of the material having the heat conductivity corresponding to JIS-SKD61 for example, the heat conductivity is too low thereby making the directional solidification difficult. On the contrary, when the heat conductivity is too high such as a copper alloy, the underfill may be generated in the undercut section. Therefore, the heat conductivity in the range mentioned above is suitable. If the heat conductivity increases as the temperature decreases within the operating temperature, the heat can be easily radiated. This is suitable for the directional solidification.

Particularly, even in the case of setting the sand core of low heat conductivity previously on the lower die to cover substantially the front surface of the lower die by the low heat conductive sand core, it is possible to carry out the effective directional solidification.

Further, according to the present invention, since the increase and decrease in the sprue temperature can be performed in a short time, it is possible to shorten the cycle time and also to make the molten metal temperature within the cavity uniform thereby to heighten the quality of the product.

BEST MODE FOR CARRYING OUT THE INVENTION

Figure 1:
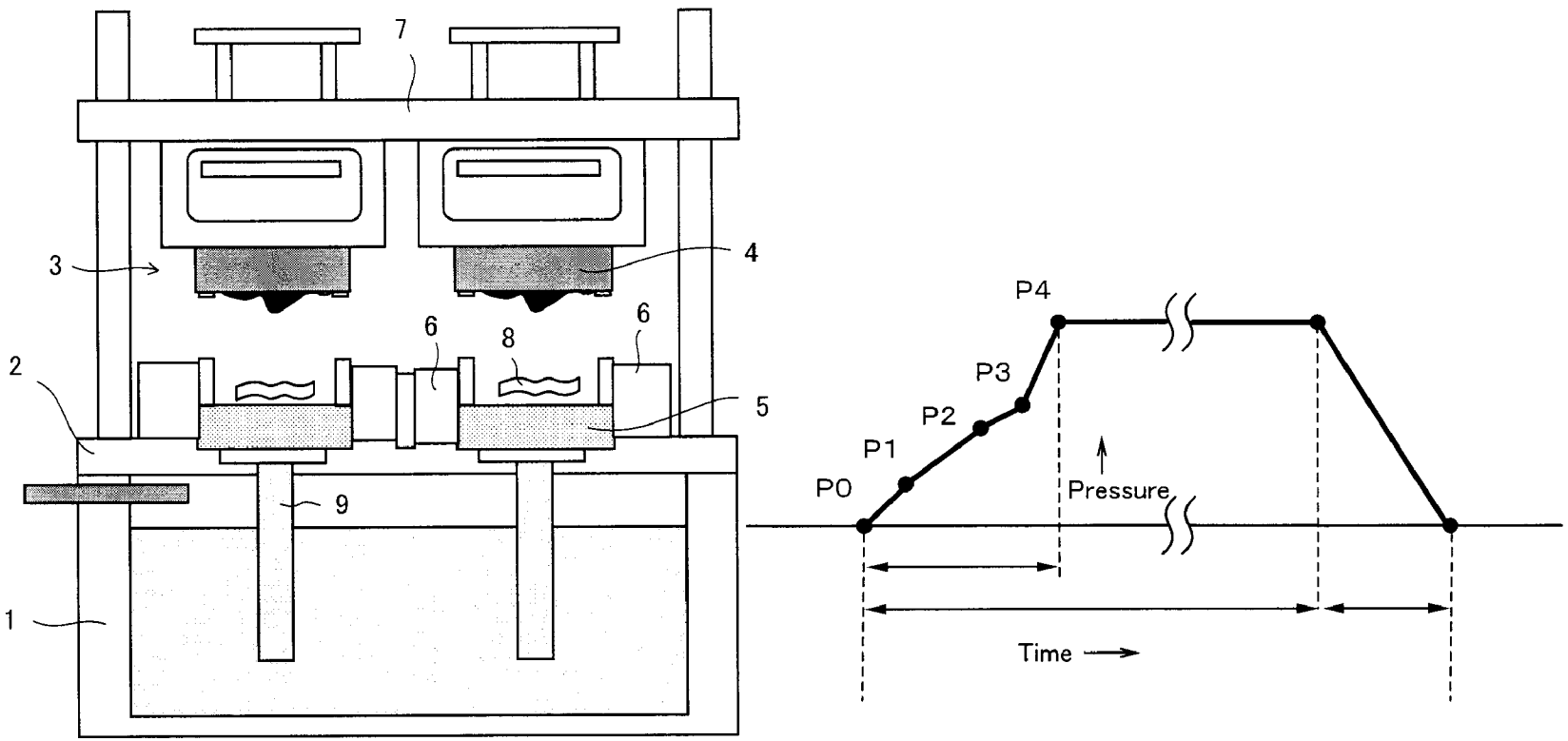
FIG. 1 A schematic view of a casting apparatus suitable for carrying out a casting method according to the present invention.
Figure 2:
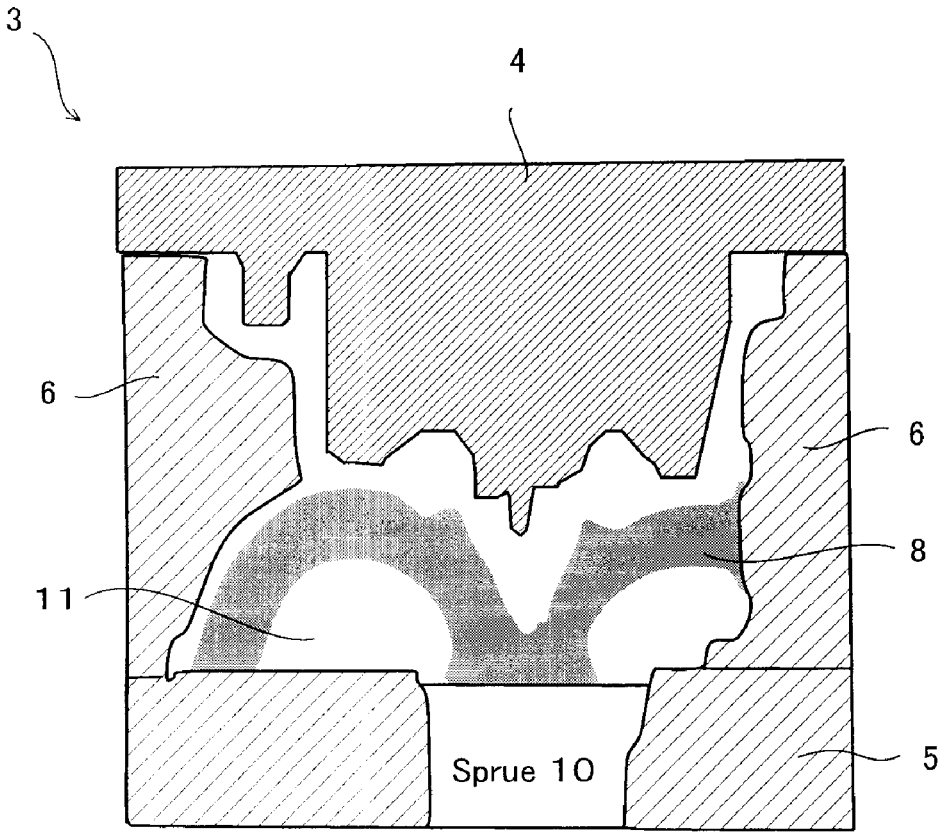
FIG. 2 An enlarged cross sectional view of a metal mold unit in a closed position.

Embodiments of the present invention will be explained hereunder with reference to the accompanying drawings. FIG. 1 is a schematic view of a casting apparatus suitable for carrying out a casting method according to the present invention, and FIG. 2 is an enlarged cross sectional view of a metal mold unit in a closed position, wherein the casting apparatus is embodied as the one for casting a cylinder head.

The casting apparatus has a molten metal reservoir 1 arranged on the bottom thereof. A metal mold unit 3 is provided on a lid 2 of the molten metal reservoir 1. The metal mold unit 3 is comprised of an upper die 4, a lower die 5, and a pair of right and left side dies (slide dies) 6. The upper die 4 is movable up and down through an elevator plate 7. A sand core 8 is set on the lower die 5. In the drawing, although there are provided two sets of the metal mold units 3, it may be limited to one set.

An iron based material which has the intermediate heat conductivity lying between the heat conductivity of a copper alloy and the heat conductivity of a material corresponding to JIS-SKD61 is used for the upper die 4. The material which has the heat conductivity corresponding to that of JIS-SKD61 is used for the lower die 5 and the side dies 6.

Figure 3:
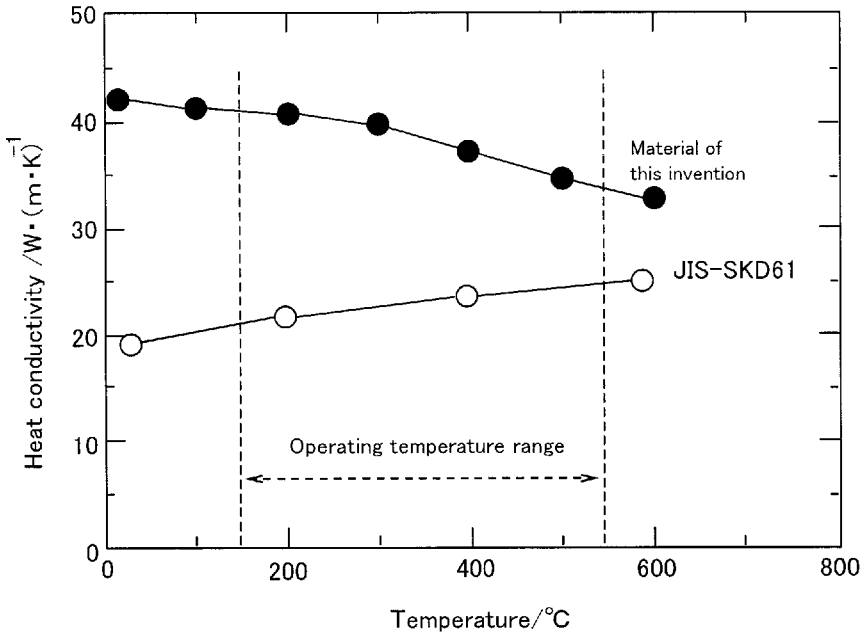
FIG. 3 A graph comparing a material of an upper die of the casting apparatus according to the present invention to a conventional die material by heat conductivity.

FIG. 3 is a graph comparing the material forming the upper die 4 to a conventional die material corresponding to JIS-SKD61 by heat conductivity. From this graph it is understood that the heat conductivity in an operating temperature (150° C.-550° C.) of the material used in the present invention is 34-41 $W\cdot(m\cdot K)^{-1}$ and the heat conductivity thereof increases as the temperature decreases.

Air is supplied from outside into the upper space of the molten metal reservoir 1. By this air pressure a molten aluminum is delivered through a supply pipe 9 to a sprue 10 formed in the lower die 4 and also supplied from the sprue 10 into a cavity 11 which is formed by closing the upper die 4, the lower die 5, the right and left side dies 6.

Figure 4:
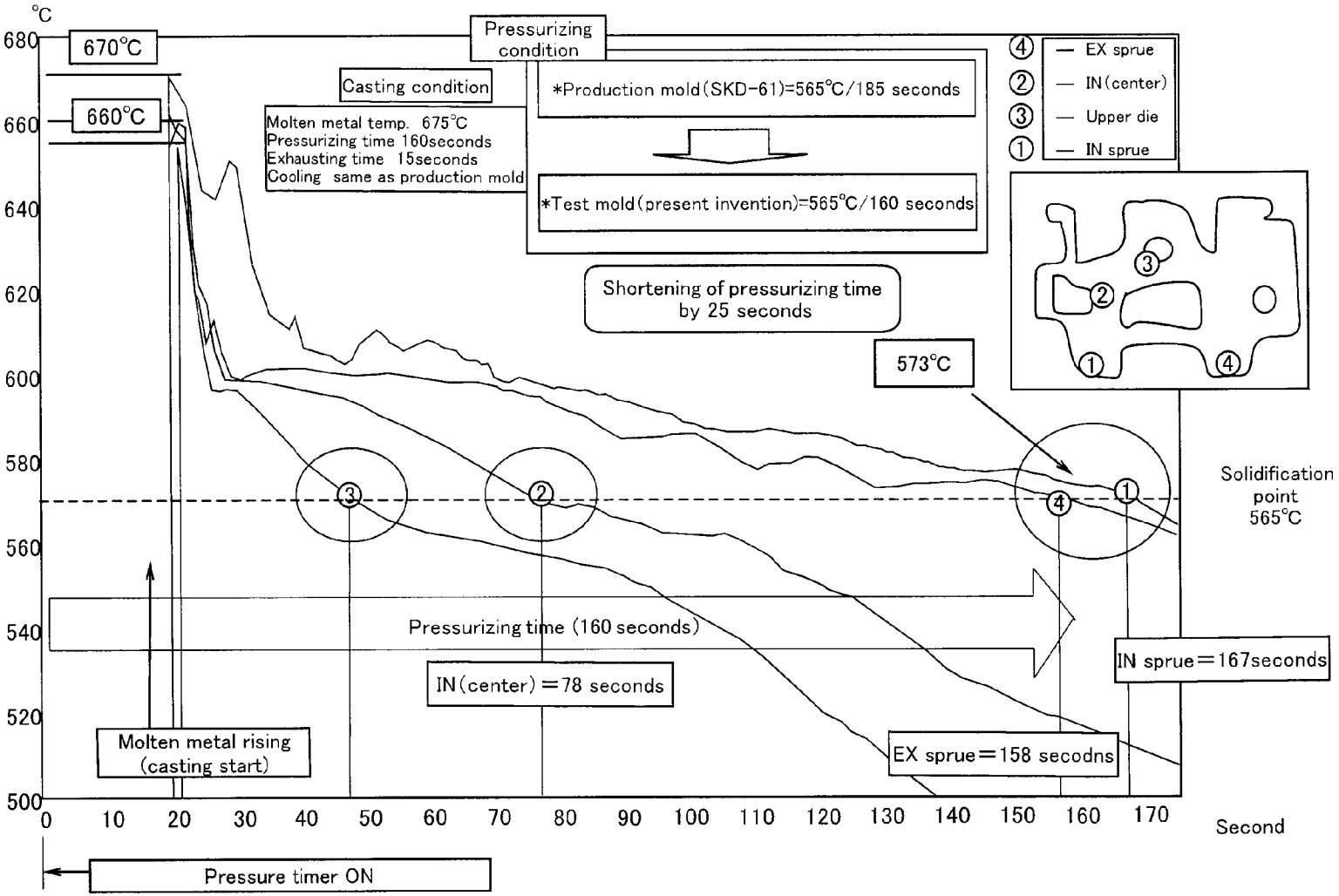
FIG. 4 A graph showing a change in temperature in principal points, at the time of casting, of the casting apparatus according to the present invention.

Next, the casting method will be explained with reference to a graph shown on the right side of FIG. 1 and the graph of FIG. 4 showing the change in temperature in essential location points.

At first, the air is sent into the upper space of the molten metal reservoir 1, so as to fill the cavity 11 with the molten aluminum. Herein, reference characters P0-P4 denote positions of a molten metal level of the molten aluminum, wherein P0 is a start position, P1 is a position at the front of the sprue, P2 is a position at the sprue, P3 is a position at the bottom of the cavity and P4 is a position at the head pressure (highest pressure).

In this embodiment, the pressure allowing the molten metal level to go up to the positions of from P0 to P4 is applied to the molten metal within the molten metal reservoir 1. Then, the pressure of P4 is maintained for a predetermined time. During this time, as shown in FIG. 4, the molten metal which comes into contact with the upper die 4 is cooled earlier than the molten metal being in contact with another die. By this cooling the molten metal shrinks. However, since the pressure of P4 is maintained, the molten metal is supplied from the lower side to a shrunk portion, so as not to cause the shrinkage cavity or the underfill.

Then, after dropping the pressure from P4 to P0, the metal mold is opened to take out the product. After air blow, the sand core is set again and the metal mold is closed, thereby carrying out next shot. By the way, the time from P0 to P1 is 27 seconds for example. The pressure maintaining time of P4 is 160 seconds for example. The pressure dropping time up to opening the metal mold is 15 seconds for example.

Moreover, during the period starting from P0 and ending the pressure maintaining time of P4, as shown in FIG. 4, the directional solidification is carried out from the portion contacting the upper die 4 to the sprue 10, within the cavity 11.

Figure 5:
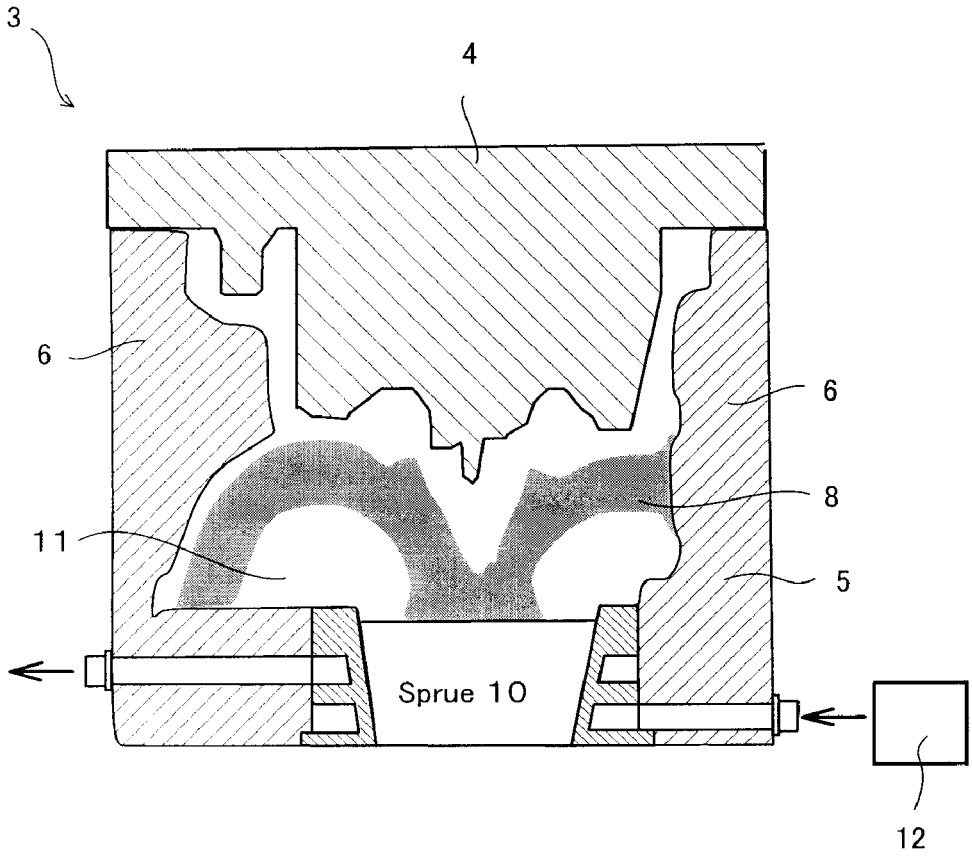
FIG. 5 A cross sectional view of a metal mold unit according to another embodiment of the present invention.

FIG. 5 is a cross sectional view of a metal mold unit according to another embodiment. In this embodiment, a sprue 10 on an IN side is comprised of a material whose heat conductivity in an operating temperature of 150° C.-550° C. is 34-41 $W\cdot(m\cdot K)^{-1}$ and whose heat conductivity increases as the temperature decreases. An air passage is formed by cutting a groove in an outer peripheral portion of the sprue 10. Air from an air cooling device (blower) 12 is supplied to this air passage to carry out rapid cooling.

A sprue collar temperature of the sprue section must be kept at a predetermined level to make preparations for next filling of the molten metal.

In this embodiment, the sprue 10 is not cooled at the beginning of the molten metal filling, but the sprue 10 is forcibly cooled at the same time that the supply of the molten metal into a cavity 11 is stopped. In consequence, the molten metal running performance can be improved at the beginning of the molten metal filling, while the unloading of the cast product can be done in a short time.

Further, not only the sprue 10 on the IN side but also the sprue on the EX side (exit side) may be comprised of the material whose heat conductivity in an operating temperature of 150° C.-550° C. is 34-41 $W\cdot(m\cdot K)^{-1}$ and whose heat conductivity increases as the temperature decreases. With this construction, the cycle time can be remarkably shortened such that the solidification positions (1) and (4) of FIG. 4 are shifted to the left side further in the drawing.

Furthermore, in the case where there are provided small die elements subject to heat storage, such as a projection for casting hole which is provided directly above the sprue of the casting metal mold, an insert and a pin, these elements can be comprised of the above material having outstanding heat conductivity.

INDUSTRIAL APPLICABILITY

While the casting method according to the present invention can be suitably applied to the method of pressure casting an aluminum alloy, it is also applicable to other casting methods.

The invention claimed is:

1. A casting method of pressure filling a molten metal from a lower side through a sprue into a cavity defined by an upper die and a lower die or into a cavity defined by the upper die, the lower die and a side die to solidify the molten metal, which comprises: using, as a material forming the sprue, a material whose heat conductivity in an operating temperature of 150° C.-550° C. is 34-41 $W\cdot(m\cdot K)^{-1}$, by mass content, 0.15% or more and 0.35% or less of C, 0.05% or more and less than 0.20% of Si, 0.05% or more and 1.50% or less of Mn, 0.20% or more and 2.50% or less of Cr, 0.50% or more and 3.00% or less of Mo, 0.05% or more and 0.30% or less of V, and the balance essentially Fe, and whose heat conductivity increases as the temperature decreases, the material of the sprue having a higher heat conductivity than material of the lower die and a material of the side die, and controlling the sprue to be forcibly cooled by supplying air into an air passage that is formed in the sprue at the same time that the supply of the molten metal into the cavity is stopped.

2. The casting method according to claim 1, wherein the forced cooling is carried out by an air cooling device which blows air against the sprue.

3. The casting method according to claim 1, wherein the upper die has the function of solidifying, cooling and shrinking the molten metal, and the sprue provided in the lower die has the function of pressure filling the cavity with the molten metal, such that the molten metal is directionally solidified from a product shaped section of the upper die to the sprue.

4. The casting method according to claim 1, wherein the molten metal is a molten aluminum alloy.

5. The casting method according to claim 1, wherein the molten metal is molten aluminum.

6. The casting method according to claim 1, wherein the casting is carried out in a state of previously setting a sand core on the lower die.

7. A casting method, comprising:

pressure filling a molten metal from a lower side through a sprue into a cavity defined by an upper die and a lower die or into a cavity defined by an upper die, a lower die and a side die to solidify the molten metal; and supplying air into an air passage that is formed in the sprue to cool the sprue at the same time that the supply of the molten metal into the cavity is stopped, wherein the sprue consisting essentially of, by mass content, 0.15% or more and 0.35% or less of C, 0.05% or more and less than 0.20% of Si, 0.05% or more and 1.50% or less of Mn, 0.20% or more and 2.50% or less of Cr, 0.50% or more and 3.00% or less of Mo, 0.05% or more and 0.30% or less of V, 0.0002% or more and 0.0020% or less of B, 0.0005% or more and 0.0100% or less of Ca, 0.01% or more and 0.15% or less of Se, 0.01% or more and 0.15% or less of Te, 0.003% or more and 0.20% or less of Zr, and the balance Fe;

the sprue has heat conductivity of 34 $W\cdot(m\cdot K)^{-1}$ to 41 $W\cdot(m\cdot K)^{-1}$ in an operating temperature of 150° C. to 550° C.;

the heat conductivity increases as the temperature decreases; and the material of the sprue has a higher heat conductivity than a material of the lower die and a material of the side die.

8. The casting method according to claim 1, wherein the molten metal is a molten aluminum alloy.

9. The casting method according to claim 7, wherein the molten metal is molten aluminum.

10. The casting method according to claim 1, wherein the sprue further comprises 0.0002% or more and 0.0020% or less of B, 0.0005% or more and 0.0100% or less of Ca, 0.01% or more and 0.15% or less of Se, 0.01% or more and 0.15% or less of Te, and 0.003% or more and 0.20% or less of Zr.

11. The casting method according to claim 1, wherein the air passage is formed in an outer peripheral portion of the sprue.

12. The casting method according to claim 1, wherein the air passage is formed by cutting a groove in an outer peripheral portion of the sprue.

13. The casting method according to claim 1, wherein the sprue is not cooled at the beginning of the molten metal filing.

14. The casting method according to claim 7, wherein the air passage is formed in an outer peripheral portion of the sprue.

15. The casting method according to claim 7, wherein the air passage is formed by cutting a groove in an outer peripheral portion of the sprue.

16. The casting method according to claim 7, wherein the sprue is not cooled at the beginning of the molten metal filing.

* * * * *